US011776494B2

(12) United States Patent
Chen et al.

(10) Patent No.: US 11,776,494 B2
(45) Date of Patent: Oct. 3, 2023

(54) BACKLIGHT DRIVING METHOD AND DEVICE FOR DRIVING A SCAN-TYPE DISPLAY

(71) Applicant: MACROBLOCK, INC., Hsinchu (TW)

(72) Inventors: Chang-Lin Chen, Hsinchu (TW); Chun-Yi Li, Hsinchu (TW); Wei-Chung Chen, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

(21) Appl. No.: 17/662,728

(22) Filed: May 10, 2022

(65) Prior Publication Data

US 2022/0366863 A1 Nov. 17, 2022

(30) Foreign Application Priority Data

May 13, 2021 (TW) ..... 110117351

(51) Int. Cl.
*G09G 3/34* (2006.01)
*G09G 3/36* (2006.01)

(52) U.S. Cl.
CPC ..... *G09G 3/3426* (2013.01); *G09G 3/3688* (2013.01); *G09G 2320/064* (2013.01)

(58) Field of Classification Search
None
See application file for complete search history.

(56) References Cited

U.S. PATENT DOCUMENTS

2008/0094344 A1* 4/2008 Kuroki ..... G09G 3/342 345/102
2010/0110097 A1* 5/2010 Nam ..... H05B 45/10 345/589
2013/0021386 A1* 1/2013 Min ..... G09G 3/3413 345/102
2015/0103105 A1* 4/2015 Kim ..... G09G 3/3426 345/102
2018/0183947 A1* 6/2018 Song ..... H04N 1/00233
2018/0293927 A1* 10/2018 Tang ..... G09G 3/204

* cited by examiner

*Primary Examiner* — Kirk W Hermann
(74) *Attorney, Agent, or Firm* — Akerman LLP; Peter A. Chiabotti

(57) ABSTRACT

A backlight driving method includes steps of: (A) receiving a piece of image data that includes a number (K) of segments, where K≥2; (B) generating a piece of adjustment data that includes a number (K) of segments; each segment of the adjustment data being generated based on a respective segment of the image data and upon receipt of the respective segment of the image data; (C) generating, based on a piece of delay data and on an original synchronization control (SC) signal that has a pulse, an internal SC signal that has a number (K) of pulses; and (D) generating a backlight driving output based on the adjustment data and the internal SC signal, so as to drive a backlight source of a scan-type display to emit light.

12 Claims, 4 Drawing Sheets

BACKLIGHT DRIVING METHOD AND DEVICE FOR DRIVING A SCAN-TYPE DISPLAY

CROSS-REFERENCE TO RELATED APPLICATION

This application claims priority of Taiwanese Patent Application No. 110117351, filed on May 13, 2021.

FIELD

The disclosure relates to display driving techniques, and more particularly to a backlight driving method and a backlight driving device for driving a scan-type display.

BACKGROUND

A conventional liquid crystal display system, which is a scan-type display system, includes a controller, a liquid crystal driver, a liquid crystal panel, a backlight driver and a backlight source.

The controller receives a serial input signal that contains an image stream. The image stream contains multiple pieces of image data. Each piece of image data is related to a respective image frame (an image of one frame of the image stream) to be shown by the conventional liquid crystal display system, and includes multiple parts respectively related to respective light transmittances of multiple horizontal strips of the liquid crystal panel. With respect to each piece of image data, the controller sequentially receives and stores the parts of the piece of image data, and sequentially outputs the parts of the piece of image data to the liquid crystal driver; and the liquid crystal driver sequentially controls the light transmittances of the horizontal strips of the liquid crystal panel based on the parts of the piece of image data in a one-to-one relationship, so that light emitted by the backlight source is modulated by the liquid crystal panel to produce the image frame relating to the piece of image data.

With respect to each piece of image data, upon completion of the storing of the piece of image data, the controller generates a respective piece of adjustment data based on the piece of image data, and outputs the piece of adjustment data and an original synchronization control signal to the backlight driver, where the piece of adjustment data is related to brightness of the backlight source, and the original synchronization control signal is related to refreshing of image frames on the conventional liquid crystal display system (i.e., an act of the conventional liquid crystal display system switching from displaying a current image frame to displaying a next image frame). Then, the backlight driver drives the backlight source to emit light based on the original synchronization control signal and the piece of adjustment data.

However, when the backlight driver drives the backlight source to emit light based on the original synchronization control signal and on the piece of adjustment data that originates from a first one of the pieces of image data (hereinafter referred to as the first piece of image data), the liquid crystal driver controls the light transmittances of the horizontal strips of the liquid crystal panel based on the piece of image data that is after the first piece of image data in time. For example, when the controller generates the piece of adjustment data based on the first piece of image data, the liquid crystal driver controls the light transmittances of the horizontal strips of the liquid crystal panel based on a second one of the pieces of image data; and when the backlight driver drives the backlight source to emit light based on the original synchronization control signal and on the piece of adjustment data that originates from the first piece of image data, the liquid crystal driver controls the light transmittances of the horizontal strips of the liquid crystal panel based on a third one of the pieces of image data. Therefore, there is a relatively large frame delay between the light emission of the backlight source and the light modulation of the liquid crystal panel, which may result in abnormal display of the image frames on the conventional liquid crystal display system.

SUMMARY

Therefore, an object of the disclosure is to provide a backlight driving method and a backlight driving device for driving a scan-type display. The backlight driving method and the backlight driving device can alleviate the drawback of the prior art.

According to an aspect of the disclosure, the backlight driving method is to be implemented by a backlight driving device, and is adapted to drive a backlight source of a scan-type display. The backlight source includes a number (K) of areas, where K is an integer no less than two. The backlight driving method includes steps of: (A) receiving a piece of image data that is related to an image frame to be shown by the scan-type display, and that includes a number (K) of segments sequentially arranged in time; (B) generating a piece of adjustment data that includes a number (K) of segments sequentially arranged in time; an $i^{th}$ one of the segments of the adjustment data being generated based on an $i^{th}$ one of the segments of the image data and upon receipt of the $i^{th}$ one of the segments of the image data, where $1 \leq i \leq K$; (C) generating an internal synchronization control signal based on an original synchronization control signal and a piece of delay data; the original synchronization control signal having a pulse that is related to refreshing of image frames on the scan-type display, and that corresponds to the adjustment data in time; the internal synchronization control signal having a number (K) of pulses that are sequentially arranged in time, and that correspond to the adjustment data in time; respective time delays of the pulses of the internal synchronization control signal with respect to the pulse of the original synchronization control signal being dependent on the delay data; and (D) generating a backlight driving output based on the adjustment data and the internal synchronization control signal and outputting the backlight driving output to the backlight source, so as to drive the backlight source to emit light in a manner that brightness of an $i^{th}$ one of the areas of the backlight source changes to be dependent on the $i^{th}$ one of the segments of the adjustment data upon appearance of an $i^{th}$ one of the pulses of the internal synchronization control signal.

According to another aspect of the disclosure, the backlight driving device is adapted to drive a backlight source of a scan-type display. The backlight source includes a number (K) of areas, where K is an integer no less than two. The backlight driving device includes a controller and a backlight driver. The controller is to receive a piece of image data that is related to an image frame to be shown by the scan-type display, and that includes a number (K) of segments sequentially arranged in time. The controller generates a piece of adjustment data that includes a number (K) of segments sequentially arranged in time. An $i^{th}$ one of the segments of the adjustment data is generated based on an $i^{th}$ one of the segments of the image data and upon receipt of the $i^{th}$ one of the segments of the image data, where $1 \leq i \leq K$. The controller further generates an original synchronization control signal and a piece of delay data. The original synchronization control signal has a pulse that is related to refreshing of image frames on the scan-type display, and that corresponds to the adjustment data in time. The backlight driver is coupled to the controller to receive the original synchronization control signal, the delay data and the adjustment data, and is adapted to be further coupled to the backlight source. The backlight driver generates an internal synchronization control signal based on the original synchronization control signal and the delay data. The internal synchronization control signal has a number (K) of pulses that are sequentially arranged in time, and that correspond to the adjustment data in time. Respective time delays of the pulses of the internal synchronization control signal with respect to the pulse of the original synchronization control signal are dependent on the delay data. The backlight driver further generates a backlight driving output based on the adjustment data and the internal synchronization control signal and outputs the backlight driving output to the backlight source, so as to drive the backlight source to emit light in a manner that brightness of an $i^{th}$ one of the areas of the backlight source changes to be dependent on the $i^{th}$ one of the segments of the adjustment data upon appearance of an $i^{th}$ one of the pulses of the internal synchronization control signal.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
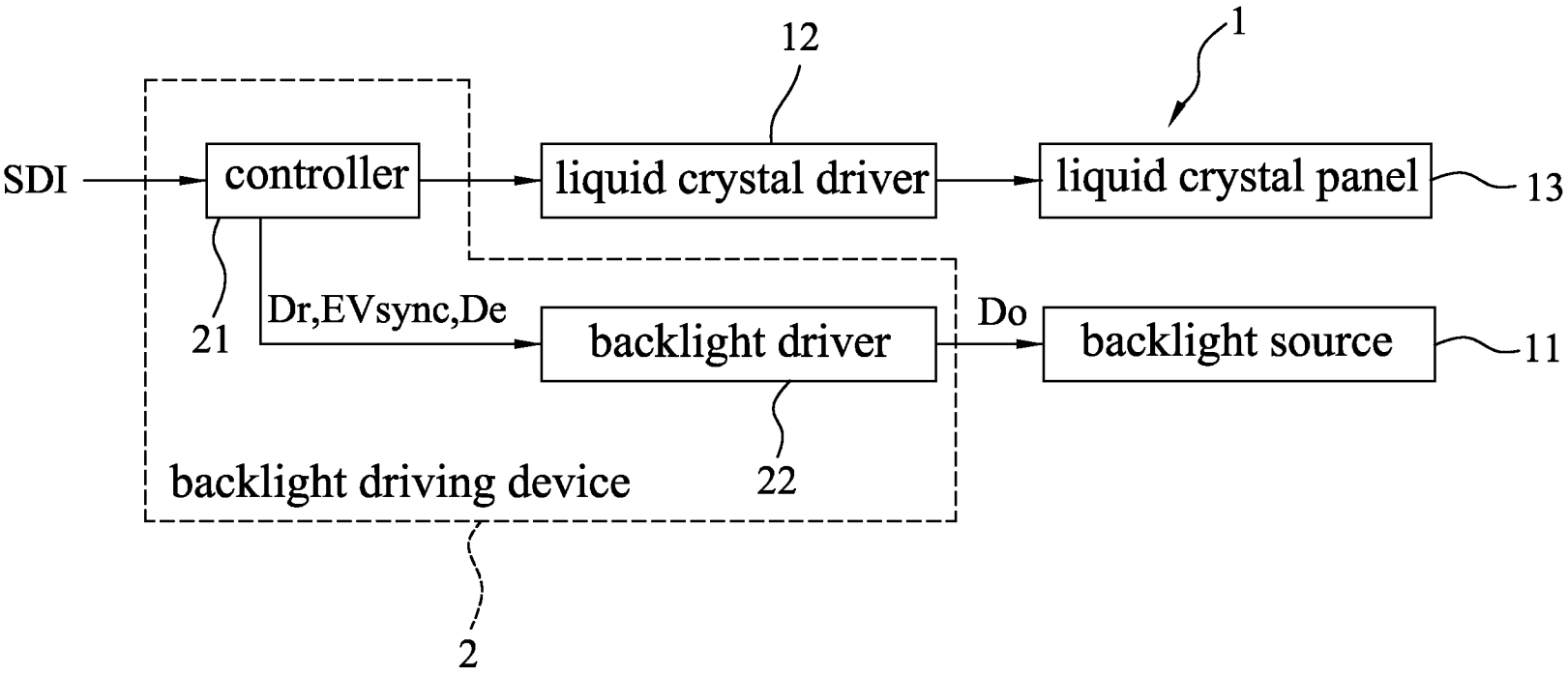
FIG. 1 is a block diagram illustrating an embodiment of a backlight driving device according to the disclosure.

Referring to FIG. 1, an embodiment of a backlight driving device 2 according to the disclosure is operatively associated with a scan-type display 1. In this embodiment, the scan-type display 1 is a liquid crystal display, supports dynamic frame rate technologies, and includes a backlight source 11, a liquid crystal driver 12, and a liquid crystal panel 13 that is coupled to the liquid crystal driver 12. The backlight driving device 2 of this embodiment performs a backlight driving method, so as to drive the backlight source 11 to emit light.

Figure 4:
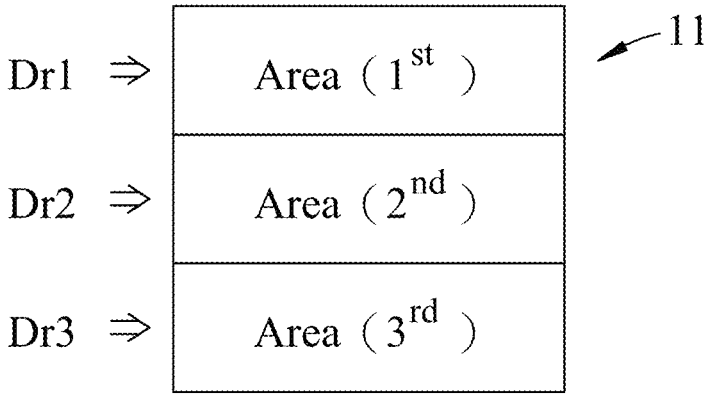
FIG. 4 is a schematic diagram illustrating a relationship between segments of the adjustment data and areas of a backlight source.

The backlight source 11 includes a plurality of switches (not shown), and a light emitting diode (LED) array (not shown) that includes a plurality of LEDs. The configuration of the backlight source 11 is known to those skilled in the art, and other details thereof are omitted herein for the sake of brevity. In this embodiment, the backlight source 11 is divided into a number (K) of areas (not shown see FIG. 4), each of which includes some of the LEDs, where K is an integer no less than two. For illustration purposes, K=3 in this embodiment.

In this embodiment, the backlight driving device 2 includes a controller 21 and a backlight driver 22. The controller 21 is adapted to be coupled to the liquid crystal driver 12. The backlight driver 22 is coupled to the controller 21, and is adapted to be further coupled to the backlight source 11.

The controller 21 is to receive a serial input signal (SDI) that contains an image stream. The image stream contains multiple pieces of image data that are sequentially arranged in time. With respect to each piece of image data, the piece of image data is related to a respective image frame to be shown by the scan-type display 1, and includes a number (K) of segments (three segments in this embodiment) that are sequentially arranged in time; each segment of the piece of image data includes a plurality of parts that are sequentially arranged in time; and the parts of the segments of the piece of image data are respectively related to respective light transmittances of multiple horizontal strips of the liquid crystal panel 13. To be specific, the controller 21 sequentially receives the parts of the segments of the piece of image data, and sequentially outputs the parts of the segments of the piece of image data to the liquid crystal driver 12; and the liquid crystal driver 12 sequentially controls the light transmittances of the horizontal strips of the liquid crystal panel 13 based on the parts of the segments of the piece of image data in a one-to-one relationship, so that light emitted by the backlight source 11 is modulated by the liquid crystal panel 13 to produce the image frame relating to the piece of image data. The aforesaid operations are known to those skilled in the art, and details thereof are omitted herein for the sake of brevity.

Figure 2:
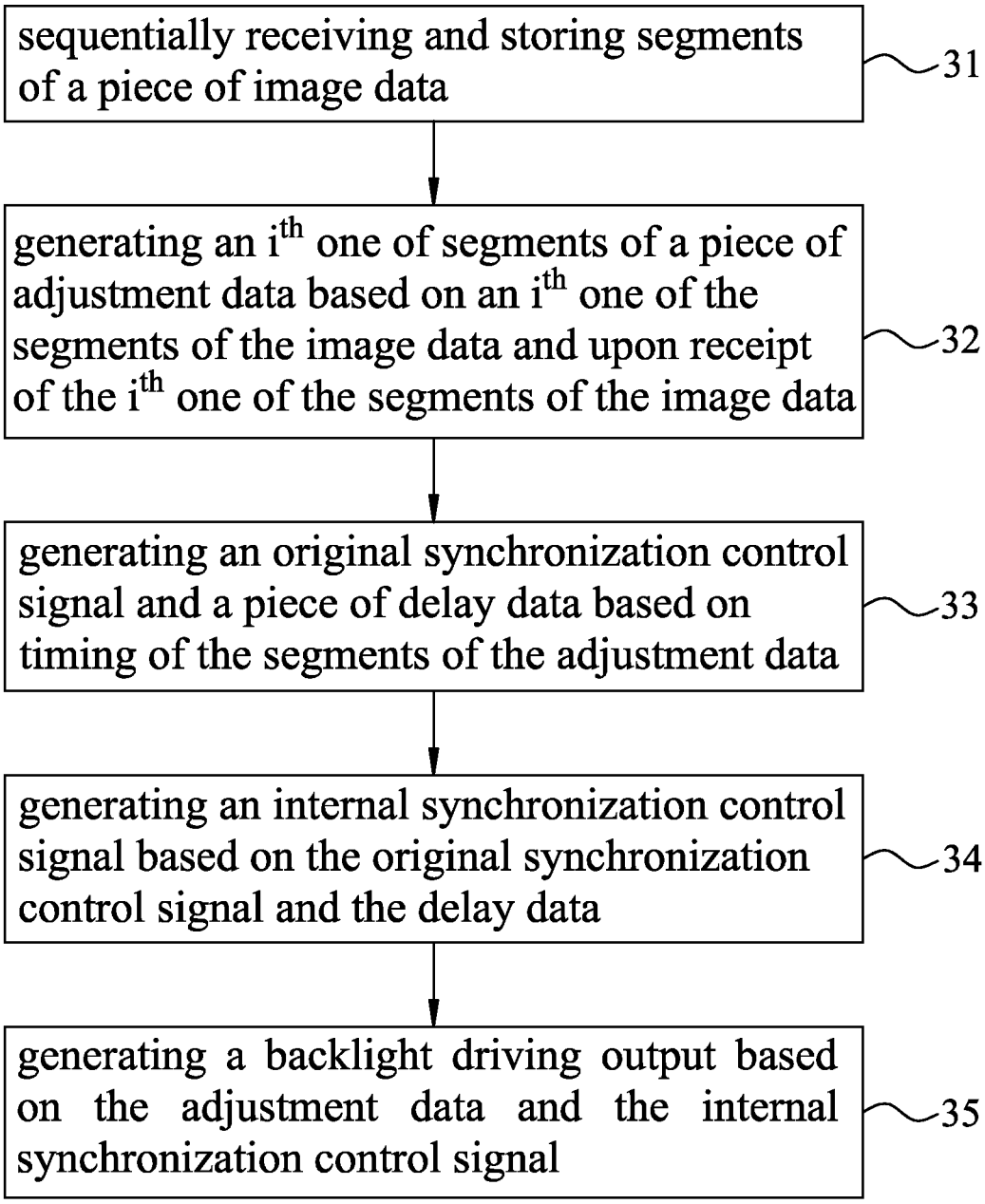
FIG. 2 is a flow chart illustrating a backlight driving method performed by the embodiment.
Figure 3:
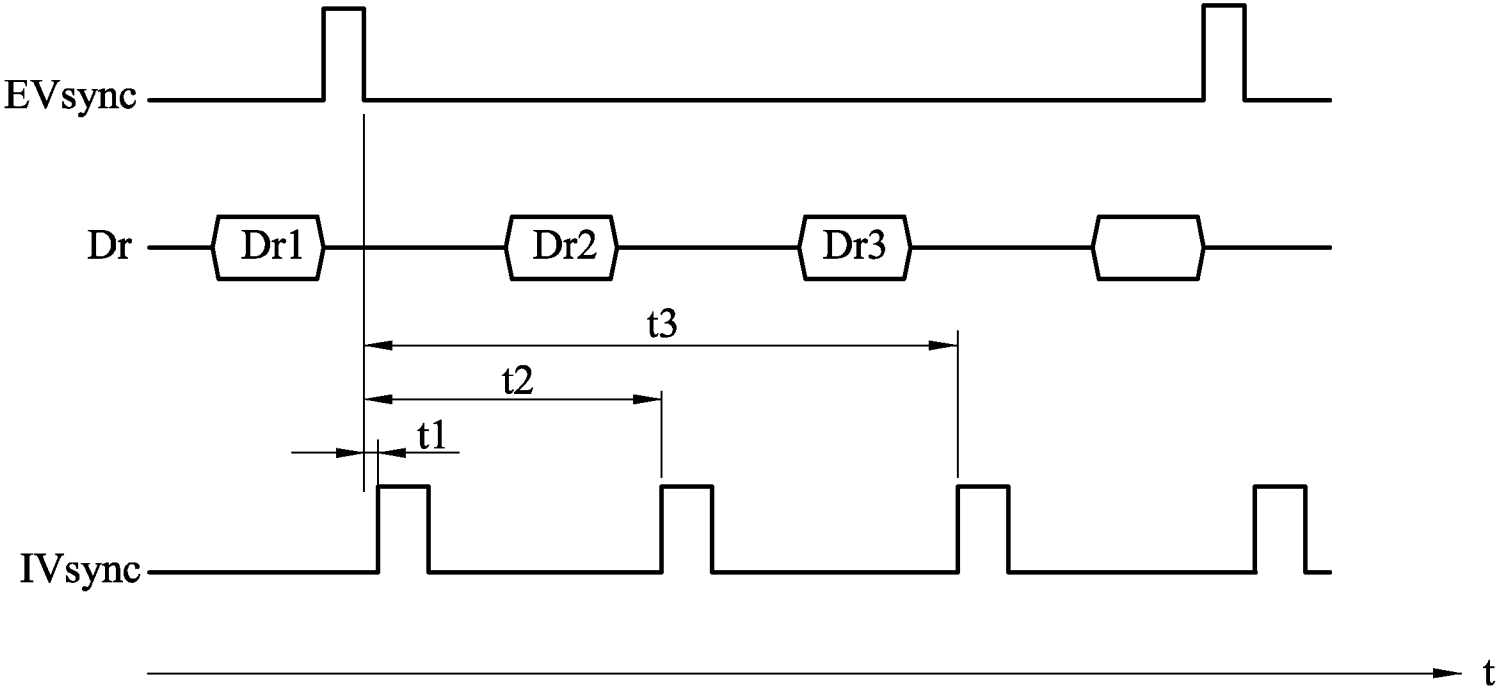
FIG. 3 is a timing diagram illustrating an original synchronization control signal, adjustment data and an internal synchronization control signal of the embodiment.

Referring to FIGS. 1, 2 and 3, in this embodiment, with respect to each piece of image data, the backlight driving device 2 performs the backlight driving method that includes steps 31-35 once, so as to drive the backlight source 11 to emit light.

In step 31, the controller 21 sequentially receives and stores the segments of the piece of image data.

In step 32, the controller 21 generates and outputs a piece of adjustment data (Dr) that includes a number (K) of segments (three segments (Dr1-Dr3) in this embodiment) sequentially arranged in time. An $i^{th}$ one of the segments (Dri) of the piece of adjustment data (Dr) is generated based on an $i^{th}$ one of the segments of the piece of image data and upon receipt of the $i^{th}$ one of the segments of the piece of image data, where $1 \leq i \leq K$ ($1 \leq i \leq 3$ in this embodiment).

As shown in FIG. 3, at first, upon receipt of a first segment of the piece of image data, the controller 21 generates a first segment (Dr1) of the piece of adjustment data (Dr) based on the first segment of the piece of image data, and outputs the first segment (Dr1) of the piece of adjustment data (Dr). Then, upon receipt of a second segment of the piece of image data, the controller 21 generates a second segment (Dr2) of the piece of adjustment data (Dr) based on the second segment of the piece of image data, and outputs the second segment (Dr2) of the piece of adjustment data (Dr). At last, upon receipt of a third segment of the piece of image data, the controller 21 generates a third segment (Dr3) of the piece of adjustment data (Dr) based on the third segment of the piece of image data, and outputs the third segment (Dr3) of the piece of adjustment data (Dr).

In step 33, the controller 21 generates an original synchronization control signal (EVsync) and a piece of delay data (De) based on timing of the generation and output of the first one of the segments (Dr1) of the piece of adjustment data (Dr), and outputs the original synchronization control signal (EVsync) and the piece of delay data (De). The original synchronization control signal (EVsync) has a pulse that is related to refreshing of image frames on the scan-type display 1, and that corresponds to the first one of the segments (Dr1) of the piece of adjustment data (Dr) in time. The piece of delay data (De) is generated after the first one of the segments (Dr1) of the piece of adjustment data (Dr) is generated and outputted, and contains a number (K) of predetermined delay values (three predetermined delay values in this embodiment).

In step 34, the backlight driver 22 receives the original synchronization control signal (EVsync), the piece of delay data (De) and the piece of adjustment data (Dr) from the controller 21, and generates an internal synchronization control signal (IVsync) based on the original synchronization control signal (EVsync) and the piece of delay data (De). The internal synchronization control signal (IVsync) has a number (K) of pulses (three pulses in this embodiment) that are sequentially arranged in time, and that respectively correspond to the segments (Dr1-Dr3) of the piece of adjustment data (Dr) in time. Respective time delays of the pulses of the internal synchronization control signal (IVsync) with respect to the pulse of the original synchronization control signal (EVsync) are respectively dependent on the predetermined delay values of the piece of delay data (De).

To be specific, as shown in FIG. 3, the pulse of the original synchronization control signal (EVsync) appears after the first one of the segments (Dr1) of the piece of adjustment data (Dr) is generated and outputted, and before the second one of the segments (Dr2) of the piece of adjustment data (Dr) is generated and outputted; a first one of the pulses of the internal synchronization control signal (IVsync) appears after the first one of the segments (Dr1) of the piece of adjustment data (Dr) is generated and outputted, and before the second one of the segments (Dr2) of the piece of adjustment data (Dr) is generated and outputted; a second one of the pulses of the internal synchronization control signal (IVsync) appears after the second one of the segments (Dr2) of the piece of adjustment data (Dr) is generated and outputted, and before the third one of the segments (Dr3) of the piece of adjustment data (Dr) is generated and outputted; a third one of the pulses of the internal synchronization control signal (IVsync) appears after the third one of the segments (Dr3) of the piece of adjustment data (Dr) is generated and outputted, and before a first one of three segments of a next piece of adjustment data (Dr) is generated and outputted; and the time delay of the $i^{th}$ one of the pulses of the internal synchronization control signal (IVsync) with respect to the pulse of the original synchronization control signal (EVsync) is dependent on an $i^{th}$ one of the predetermined delay values, where $1 \leq i \leq K$ ($1 \leq i \leq 3$ in this embodiment). For example, a time interval (ti) between the pulse of the original synchronization control signal (EVsync) and the $i^{th}$ one of the pulses of the internal synchronization control signal (IVsync) is determined by the one of the predetermined delay values (e.g., being equal to a product of the $i^{th}$ one of the predetermined delay values and a predetermined time length). It should be noted that, in this embodiment, the predetermined delay values form an arithmetic progression with a positive common difference, so a difference between the time intervals (t1, t2) is equal to a difference between the time intervals (t2, t3). However, in another embodiment, the predetermined delay values form a strictly monotonically increasing sequence, and differences between each two adjacent ones of the predetermined delay values are different from one another, so the difference between the time intervals (t1, t2) is different from the difference between the time intervals (t2, t3). Moreover, in yet another embodiment, a first one of the predetermined delay values is zero, so the time interval (t1) is zero.

In step 35, the backlight driver 22 generates a backlight driving output (Do) based on the piece of adjustment data (Dr) and the internal synchronization control signal (IVsync) and outputs the backlight driving output (Do) to the backlight source 11, so as to drive the backlight source 11 to emit light in a manner that brightness of an one of the areas of the backlight source 11 changes to be dependent on the $i^{th}$ one of the segments (Dri) of the adjustment data (Dr) upon appearance of the $i^{th}$ one of the pulses of the internal synchronization control signal (IVsync), where $1 \leq i \leq K$ ($1 \leq i \leq 3$ in this embodiment).

For example, the LEDs of the LED array of the backlight source 11 are arranged in a matrix that has nine rows and five columns, the first to third rows of the LED array of the backlight source 11 belong to a first one of the areas of the backlight source 11, the fourth to sixth rows of the LED array of the backlight source 11 belong to a second one of the areas of the backlight source 11, and the seventh to ninth rows of the LED array of the backlight source 11 belong to a third one of the areas of the backlight source 11. With respect to each piece of image data, each segment of the piece of image data includes three parts, the three parts of the first one of the segments of the piece of image data are respectively related to respective brightnesses of the first to third rows of the LED array of the backlight source 11, the three parts of the second one of the segments of the piece of image data are respectively related to respective brightnesses of the fourth to sixth rows of the LED array of the backlight source 11, and the three parts of the third one of the segments of the piece of image data are respectively related to respective brightnesses of the seventh to ninth rows of the LED array of the backlight source 11. When the liquid crystal driver 12 controls the light transmittances of the horizontal strips of the liquid crystal panel 13 based on the piece of image data, the backlight driving device 2 of this embodiment operates as follows. Upon appearance of a first one of the pulses of the internal synchronization control signal (IVsync), the backlight driver 22 generates the backlight driving output (Do) based on the first one of the segments (Dr1) of the piece of adjustment data (Dr) that originates from the piece of image data to drive the backlight source 11, so that the brightness of the first one of the areas of the backlight source 11 (including the respective brightnesses of the first to third rows of the LED array of the backlight source 11) becomes dependent on the first one of the segments (Dr1) of the piece of adjustment data (Dr) that originates from the piece of image data, and so that the brightness of the second one of the areas of the backlight source 11 (including the respective brightnesses of the fourth to sixth rows of the LED array of the backlight source 11) and the brightness of the third one of the areas of the backlight source 11 (including the respective brightnesses of the seventh to ninth rows of the LED array of the backlight source 11) remain unchanged. Upon appearance of a second one of the pulses of the internal synchronization control signal (IVsync), the backlight driver 22 generates the backlight driving output (Do) based on the second one of the segments (Dr2) of the piece of adjustment data (Dr) that originates from the piece of image data to drive the backlight source 11, so that the brightness of the second one of the areas of the backlight source 11 becomes dependent on the second one of the segments (Dr2) of the piece of adjustment data (Dr) that originates from the piece of image data, and so that the respective brightnesses of the first and third ones of the areas of the backlight source 11 remain unchanged. Upon appearance of a third one of the pulses of the internal synchronization control signal (IVsync), the backlight driver 22 generates the backlight driving output (Do) based on the third one of the segments (Dr3) of the piece of adjustment data (Dr) that originates from the piece of image data to drive the backlight source 11, so that the brightness of the third one of the areas of the backlight source 11 (including the respective brightnesses of the seventh to ninth rows of the LED array of the backlight source 11) becomes dependent on the third one of the segments (Dr3) of the piece of adjustment data (Dr) that originates from the piece of image data, and so that the respective brightnesses of the first and second ones of the areas of the backlight source 11 remain unchanged.

In view of the above, in this embodiment, by virtue of the backlight driving device 2 performing the backlight driving method, the brightness of the backlight source 11 is changed in response to receipt of each segment of any piece of image data, instead of being changed in response to the complete reception of all segments of any piece of image data. Therefore, there is a relatively small frame delay between the light emission of the backlight source 11 and the light modulation of the liquid crystal panel 13, thereby alleviating abnormal display of the image frames on the scan-type display 1.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A backlight driving method to be implemented by a backlight driving device, and adapted to drive a backlight source of a scan-type display; the backlight source including a number (K) of areas, where K is an integer no less than two; said backlight driving method comprising steps of:

(A) receiving a piece of image data that is related to an image frame to be shown by the scan-type display, and that includes a number (K) of segments sequentially arranged in time;

(B) generating a piece of adjustment data that includes a number (K) of segments sequentially arranged in time; an $i^{th}$ one of the segments of the adjustment data being generated based on an $i^{th}$ one of the segments of the image data and upon receipt of the $i^{th}$ one of the segments of the image data, where $1 \le i \le K$;

(C) generating an internal synchronization control signal based on an original synchronization control signal and a piece of delay data; the original synchronization control signal having a pulse that is related to refreshing of image frames on the scan-type display, and that corresponds to the adjustment data in time; the internal synchronization control signal having a number (K) of pulses that are sequentially arranged in time, and that correspond to the adjustment data in time; respective time delays of the pulses of the internal synchronization control signal with respect to the pulse of the original synchronization control signal being dependent on the delay data; a starting point of an $i^{th}$ one of the pulses of the internal synchronization control signal appearing after the $i^{th}$ one of the segments of the adjustment data being generated; an end point of a $j^{th}$ one of the pulses of the internal synchronization control signal appearing before a $(j+1)^{th}$ one of the segments of the adjustment data being generated, where $1 \le j \le K$; and (D) generating a backlight driving output based on the adjustment data and the internal synchronization control signal and outputting the backlight driving output to the backlight source, so as to drive the backlight source to emit light in a manner that brightness of an $i^{th}$ one of the areas of the backlight source changes to be dependent on the $i^{th}$ one of the segments of the adjustment data upon appearance of an $i^{th}$ one of the pulses of the internal synchronization control signal.

2. The backlight driving method of claim 1, wherein:

the delay data contains a number (K) of predetermined delay values;

the pulse of the original synchronization control signal appears after a first one of the segments of the adjustment data is generated; and a time interval between the pulse of the original synchronization control signal and the $i^{th}$ one of the pulses of the internal synchronization control signal is determined by an $i^{th}$ one of the predetermined delay values.

3. The backlight driving method of claim 1, wherein:

the delay data contains a number (K) of predetermined delay values; and in step (C), the time delay of the $i^{th}$ one of the pulses of the internal synchronization control signal with respect to the pulse of the original synchronization control signal is dependent on an $i^{th}$ one of the predetermined delay values.

4. The backlight driving method of claim 3, wherein:

$K \ge 3$; and the predetermined delay values form an arithmetic progression with a positive common difference.

5. The backlight driving method of claim 3, wherein:

$K \ge 3$;

the predetermined delay values form a strictly monotonically increasing sequence; and differences, between each two adjacent ones of the predetermined delay values, are different from one another.

6. The backlight driving method of claim 3, wherein a first one of the predetermined delay values is zero.

7. A backlight driving device adapted to drive a backlight source of a scan-type display; the backlight source including a number (K) of areas, where K is an integer no less than two; said backlight driving device comprising:

a controller to receive a piece of image data that is related to an image frame to be shown by the scan-type display, and that includes a number (K) of segments sequentially arranged in time;

said controller generating a piece of adjustment data that includes a number (K) of segments sequentially arranged in time; an $i^{th}$ one of the segments of the adjustment data being generated based on an $i^{th}$ one of the segments of the image data and upon receipt of the $i^{th}$ one of the segments of the image data, where $1 \leq i \leq K$;

said controller further generating an original synchronization control signal and a piece of delay data; the original synchronization control signal having a pulse that is related to refreshing of image frames on the scan-type display, and that corresponds to the adjustment data in time; and a backlight driver coupled to said controller to receive the original synchronization control signal, the delay data and the adjustment data, and adapted to be further coupled to the backlight source;

said backlight driver generating an internal synchronization control signal based on the original synchronization control signal and the delay data; the internal synchronization control signal having a number (K) of pulses that are sequentially arranged in time, and that correspond to the adjustment data in time; respective time delays of the pulses of the internal synchronization control signal with respect to the pulse of the original synchronization control signal being dependent on the delay data; a starting point of an $i^{th}$ one of the pulses of the internal synchronization control signal appearing after the $i^{th}$ one of the segments of the adjustment data being generated; an end point of a $j^{th}$ one of the pulses of the internal synchronization control signal appearing before a $(j+1)^{th}$ one of the segments of the adjustment data being generated, where $1 \leq j \leq K$;

said backlight driver further generating a backlight driving output based on the adjustment data and the internal synchronization control signal and outputting the backlight driving output to the backlight source, so as to drive the backlight source to emit light in a manner that brightness of an $i^{th}$ one of the areas of the backlight source changes to be dependent on the $i^{th}$ one of the segments of the adjustment data upon appearance of an $i^{th}$ one of the pulses of the internal synchronization control signal.

8. The backlight driving device of claim 7, wherein:

the delay data contains a number (K) of predetermined delay values;

the pulse of the original synchronization control signal appears after a first one of the segments of the adjustment data is generated; and a time interval between the pulse of the original synchronization control signal and the $i^{th}$ one of the pulses of the internal synchronization control signal is determined by an $i^{th}$ one of the predetermined delay values.

9. The backlight driving device of claim 7, wherein:

the delay data contains a number (K) of predetermined delay values; and the time delay of the $i^{th}$ one of the pulses of the internal synchronization control signal with respect to the pulse of the original synchronization control signal is dependent on an $i^{th}$ one of the predetermined delay values.

10. The backlight driving device of claim 9, wherein:

$K \geq 3$; and the predetermined delay values form an arithmetic progression with a positive common difference.

11. The backlight driving device of claim 9, wherein:

$K \geq 3$;

the predetermined delay values form a strictly monotonically increasing sequence; and differences, between each two adjacent ones of the predetermined delay values, are different from one another.

12. The backlight driving device of claim 9, wherein a first one of the predetermined delay values is zero.

* * * * *